US005775048A

United States Patent [19]

Orchard

[11] Patent Number: 5,775,048

[45] Date of Patent: Jul. 7, 1998

[54] UNDER DECK FASTENING SYSTEM

[76] Inventor: Brian Keith Orchard, 1640 Estevan Road, London, Canada, N5X 2G9

[21] Appl. No.: 678,687

[22] Filed: Jul. 11, 1996

[30] Foreign Application Priority Data

Jul. 17, 1995 [CA] Canada ..... 2154035

[51] Int. Cl.[6] ..... F04B 1/38; F16B 1/00

[52] U.S. Cl. ..... 52/712; 52/512; 52/702; 403/231

[58] Field of Search ..... 52/474, 480, 483.1, 52/489.1, 512, 513, 578, 582.1, 698, 702, 712, 715, 781.3, 403.1, 459, 460, 461, 463, 506.01, 506.05, 509; 403/230, 231, 233

[56] References Cited

U.S. PATENT DOCUMENTS

| | | | |
|---|---|---|---|
| 816,297 | 3/1906 | Charls | 52/712 |
| 3,276,180 | 10/1966 | Westinghouse | 52/461 X |
| 3,359,701 | 12/1967 | Schneller | 52/712 |
| 3,413,771 | 12/1968 | Dudley . | |
| 3,786,608 | 1/1974 | Boettcher . | |
| 4,620,403 | 11/1986 | Field . | |
| 4,635,424 | 1/1987 | Drapeau . | |
| 4,856,250 | 8/1989 | Gronau et al. . | |
| 4,965,980 | 10/1990 | Leavens | 52/712 |
| 5,160,211 | 11/1992 | Gilb | 52/712 X |
| 5,274,977 | 1/1994 | Bayly . | |
| 5,361,554 | 11/1994 | Bryan . | |

FOREIGN PATENT DOCUMENTS

| | | |
|---|---|---|
| 398194 | 7/1941 | Canada . |
| 965569 | 4/1975 | Canada . |
| 1027729 | 3/1978 | Canada . |
| 1077228 | 5/1980 | Canada . |
| 1167619 | 5/1984 | Canada . |
| 1298455 | 7/1987 | Canada . |
| 1290131 | 3/1988 | Canada . |
| 1263007 | 11/1989 | Canada . |

*Primary Examiner*—Wynn E. Wood
*Assistant Examiner*—Kevin D. Wilkens
*Attorney, Agent, or Firm*—Deeth Williams Wall; Eileen McMahon; Gervas Wall

[57] ABSTRACT

A deck fastening system includes an underdeck elongated fastening clip. Such clip is in the form of an elongated metallic sheet of a predetermined width. The clip has a profile defined by a fastening flange, and a depending facia projecting at right angles to the fastening flange from the leading edge thereof, which terminates in an intersecting valley. An angularly upwardly-extending track projects from the intersecting valley at the lower end of the depending facia. A washer flange extends outwardly from the leading edge of the angularly-upwardly-extending track.

8 Claims, 2 Drawing Sheets

PRIOR ART

UNDER DECK FASTENING SYSTEM

BACKGROUND OF THE INVENTION

1. Field of the Invention

This invention relates to wooden decks and, in particular, to a system for use in constructing wooden decks.

2. Description of the Prior Art

Numerous house decks have been provided in the prior art that are adapted to contain wooden horizontal floors raised above the level of adjacent ground areas to be utilized for dining and recreation, the floors projecting from the sides of building structures. Such raised wooden outside decks are frequently being combined with sliding patio doors that give access to the deck or patio. Such decks are usually built of lumber, having a supporting frame and sub-structure, including joists and headers, to which a decking of solid board lumber is nailed. Many decks are subject to severe climatic conditions that cause shrinking and working of the boards, leading to cracking of the boards and partial drawing of the nails. This is both unsightly, and a safety hazard, while the nails can rust and cause discolouration.

In constructing wooden decking it is known to construct widely spaced support beams or joists first, and then to cover the area with abutting planks laid across the transversal joists. The planks of wood are generally fastened by nailing them to the edge, and to have cross-wise laid joists underneath. The nail heads are therefore visible, which is generally not desirable, particularly if they rust as in outdoors decking structures. Another disadvantage of using nails is that, in horizontal structures, the depressions created in the top surface of the planks by nailing them collect rain water and accelerate the deterioration of the wooden planks. Yet another disadvantage was that misdirected hammer blows could also damage the exposed surface of the boards when the boards were being nailed to the joists, and the nails could split the boards. Finally, the nails used for decks were prone to working themselves out of the joists as the boards flexed, e.g., when people walked on the deck. This could loosen the boards from the joists and could raise the nailheads above the deck surface, causing a safety hazard.

In an effort to simplify such construction and to make it more durable, the prior art provided patents which generally involved the use of clips or brackets. For example, Canadian Patent 398,194, patented Jul. 22, 1941, by H. H. Burson, provided a clip which afforded a "floating" surface. A spacing of the board sections was provided at a slight distance from the beams, studdings, or other structural elements, so that strains, shocks, or vibrations transmitted through the structure would not be imparted in like degree to the surface. In the patented construction, two clips were used, each consisting of a body portion having, a pair of channel-forming tongues extending in right angular relation to the body at the edge thereof along one of its edges. An intermediate attaching tongue was offset with respect to the edge of the body and stood in right angular relation to the plane of the body portion and was provided with a nailing aperture. The body had an apertured nailing tongue along its opposite edge, extending outwardly within the plane of the body and had channel forming tongues extending at right angles to the plane of the body to combine in affording a channel. The two clips were associated to bring the offset attaching tongue of one of the clips into register with the attaching tongue of the companion clip and in overlying relation thereto. A single nail entered through the registering nailing apertures for uniting the two clips.

Canadian Patent 965,569, patented Apr. 8, 1975, by W. R. Morgan, Jr., provided a flooring system of the tongue-and-groove type. In such patented system, a plurality of flooring boards was used along with a plurality of clips. The floor boards each comprised an upper wearing surface, a bottom surface, and longitudinally-extending sides comprising a first side and a second side. The boards were adapted for location in side-by-side relationship on a support with the clips having engaging fingers for securing the boards to the support. The first side of each board defined a first surface portion which extended downwardly from the wearing surface and tapered inwardly away from the vertical and toward the centre of the board. A second horizontal surface portion extended from its intersection with the first surface portion outwardly away from the centre of the board. A third surface portion extended downwardly from the outer edge of the second surface portion and tapered inwardly away from the vertical and toward the centre of the board to said bottom surface. The combination of the second and third surfaces defined a tongue on the board. The second side of each board comprised a first surface portion which extended downwardly from the wearing surface and tapered outwardly away from the vertical and away from the centre of the board. A second horizontal surface portion extended from its intersection with the first surface portion inwardly toward the centre of the board. A third surface portion extended downwardly from the inner edge of the second surface portion and tapered outwardly away from the vertical and away from the centre of the board to the bottom surface. The second and third surfaces of the second side defined a recess for receiving the tongue. The surface portion of the first side comprised an uninterrupted surface. A groove extended along the second side only of the board for receiving clip fingers. The groove extended inwardly of the board as a continuation of the second surface on the second side. Each of the clips had clip fingers which extended horizontally, the body portion of each clip comprising an angularly-extending portion which conformed to the third surface portion of said second side. This angularly extending portion of each clip snugly engaged the third surface of the second side and was snugly engaged by the third surface portion on the first side of the adjacent board. The first, second and third surface portions of the first side were adapted to mate, respectively, with the first, second and third surface portions of the second side of an adjacent board in the system. The intersections between each of the first and second surface portions was located below centre in the boards. The wearing depth of the flooring boards was greater than one-half the board thickness.

Canadian Patent 1,027,729, patented Mar. 14, 1978, by F. H. Lindsay, provided a floor frame assembly. Such patented floor frame assembly included a plurality of horizontal and parallel lower beams. A plurality of parallel upper beams was positioned above the lower beams. A plurality of vertical members was mounted to and between the lower beams and the upper beams. A plurality of cross braces had opposite ends attached to the vertical members, the cross braces being attached to the lower beams and extending upwardly from the lower beams to the upper beams. At least one reinforcing beam extended lengthwise through the assembly, the reinforcing beam being mounted perpendicular to the upper beams and the lower beams. A floor was mounted atop and to the upper beams. The cross braces were located only in the outer one-third portion of the frame assembly. A bracket was secured to the beam and supported a runner beneath the unified floor frame.

Canadian Patent 1,077,228, patented May 13, 1980, by D. M. Taylor et al., provided connectors for interlocked channel sections. The patented clip connector anchored pairs of rigid interlocked metal panels of channel configuration to spaced supporting members. The clip included a body portion having an upstanding planar element, an upper horizontal planar portion and a deformable flange hook portion. Such hook portion included a planar element depending downwardly from the upper portion and was deformable towards the upstanding planar element at the line of juncture between the deformable flange hook portion and the upper horizontal planar portion. An outermost bend retention hook extended from the free end of the deformable flange hook portion of the body portion. The retention hook terminated in a free end positioned between the upstanding planar element and the deformable hook portion. The clip connector was formed such that a particular included angle was provided between the upper horizontal planar portion and the flange hook portion. A foot was formed from the bottom of the said planar element and extended therefrom, the foot having an elongated slot formed therein extending horizontally thereof substantially parallel to the body portion. A washer overlay the foot, the washer having an aperture therethrough in alignment with the elongated slot. During thermal movement of the panels, the panels were allowed to move with respect to the supporting members.

Canadian Patent 1,167,619, patented May 22, 1984, by K. J. Hildebrand, provided an antisqueak bracket, which included a support attachment plate. A ii subfloor attachment plate extended perpendicularly from one edge of the support attachment plate and upon one side thereof. Spacer and positioning means extended upwardly from adjacent the distal edge of the support attachment plate perpendicular to the plane thereof and parallel to the plane of the supporting plate.

Canadian Patent 1,263,007, patented Nov. 21, 1989, by C. W. Abendroth, provided a fastener for flooring systems, which included a foundation and a plurality of adjacent floorboards. Each of the floorboards included a vertical side including a horizontal slot, and a base adjacent the foundation. A first opening in the base was spaced from the side and a second opening was spaced from the side and from the first opening. A plurality of clips were provided. Each clip included a horizontal upper portion received in the slot in the floorboard, a vertical portion, and a lower horizontal base portion extending between the foundation and the base of the floorboard. A first projection extended outwardly on the base portion and was received in the first opening in the floorboard. A second projection extended outwardly on the base portion and was received in the second opening in the floorboard.

Canadian Patent 1,290,131, patented Oct. 8, 1991, by M. E. J. Classen, provided a deck clip used to mount deck planks on a joist. It included a planar body for mounting on the joist to define a space between adjacent planks supported by the joist. The planar arm extended downwardly from one end of the planar body in a vertical plane angled with respect to the plane of the body for engaging one side of the joist, and for receiving a fastener to connect the bracket to the joist. Prongs extended outwardly from each side of the body for penetrating a plank.

Canadian Patent 1,298,455, patented Apr. 7, 1992, by J. W. Partridge, provided a fastening clip and wooden plank assembly. The assembly included a metal strip having a predetermined thickness and having a central portion thereof stamped out to protrude on one side and shaped to form a shank which was perpendicular to the metal strip and which terminated in a tapered arrowhead-like portion which was parallel to the metal strip, for piercing and engaging an edge of a first wooden plank. The portion of the metal strip which projected beyond the edge of the wooden plank on one side of the shank engaged the underside of an edgewise contiguous second wooden plank which was anchored to a plurality of supporting joists running cross-wise underneath the first and second wooden planks. The first wooden plank was, therefore, prevented from curling upwardly along the edge.

U.S. Pat. No. 3,786,608, patented Jan. 22, 1974, by W. A. Boettcher, provided a flooring sleeper assembly which comprised a retainer and flooring sleepers made up of a linear series of sections. These were of fibreboard material and have a slot in one side edge. The retainer was a long, metallic receptacle for the series of sleeper sections, such receptacle rising with a channel on one side which terminated with an inward hook directed into the slot in the sleeper. On the opposite side, the receptacle rose with a vertical flange. The latter and the channel formed guards to check lateral shifting tendencies of the sleeper sections. The hook checked them from rising out of the retainer.

U.S. Pat. No. 4,620,403, patented Nov. 4, 1986, by G. L. Field, provided anchors for positioning and attaching a series of parallel wooden boards or slats to wooden joists or rails. The patented nailing anchor had two flat, horizontal tabs each positionable between one of a pair of adjacent boards and the joist. The tabs were fixedly attached to a flat spacer body and extended perpendicularly therefrom in opposite directions. A hole in one tab allowed the anchor to be nailed to the joist. An elongated slot in the spacer body allowed the anchor to be toe-nailed through one adjacent board into the joist. A flat, triangular point depended perpendicularly from an upper edge of the spacer for fastening one board to the spacer body.

U.S. Pat. No. 4,635,424, patented Jan. 13, 1987, by R. Drapeau, provided a one-piece fastener which was made of a thin plate having, on one face, at least one fastening tongue intended to be inserted into a corresponding groove provided on the lining element in order to secure and hold on to the latter. The plate had, on the other face, at least one set of teeth capable of simultaneously locking, in a reversible manner, by simple pressure on two parallel edges forming an integral part of a rail secured rigidly to the carrying surface to be lined or finished. U.S. Pat. No. 5,274,977, patented Jan. 4, 1994, by D. H. Bayly, provided an allegedly improved decking system, e.g., for house decks. The patented decking system was for an exterior deck extending from one side of a building. The exterior deck had a header around its periphery, a railing on the header and a plurality of joists spaced apart in parallel relationships between the header. The decking system included a plurality of plastic flooring members extending in slightly spaced-apart parallel relationships transversely across the joists. Each plastic flooring member was an elongated E-shaped channel to give extra strength thereto when placed transversely across the joists. Each elongated E-shaped channel included a web portion, a pair of end flange portions and a central flange portion. The pair of end flange portions and the central flange portion were all of the same thickness and were wide enough for securing means. The securing means included each such E-shaped channel having a plurality of spaced apart pilot holes drilled through each such end flange portion and a plurality of fasteners, each driven through each such pilot hole in each E-shaped channel and into one of the joists.

U.S. Pat. No. 5,361,554, patented Nov. 8, 1994, by R. Bryan, provided a prefabricated deck system. The prefabricated decking system included a decking modular block for surfacing a deck. The modular block had a top face and a reverse face comprised of a plurality of lateral bars, each lateral bar having first and second longitudinal ends, each longitudinal end of each lateral bar having a recess defined therein. A first tie member was splined into the recesses of the first ends of the lateral bars. A second tie member was splined into the recesses of the second ends of the lateral bars. At least one fastener member pierced each end of each lateral bar and the respective tie member which was splined into the recess thereof. The lateral bars were thus secured in closely spaced, mutually parallel relation.

SUMMARY OF THE INVENTION

Aims of the Invention

In spite of the above-described patents, a fastening clip has not yet been provided which would permit the construction of wooden decks simply and effectively without any visible nails.

There has also been a significant need for a nailing anchor and a method of using the anchor which is designed to overcome these problems and disadvantages.

One object therefore of the present invention is to overcome problems inherent to the above-described patented device by providing a relatively simple deck bracket, which requires a minimum of nails or screws.

A further object of the present invention is to provide an improved decking system that is simple and easy to use.

A still further object of the present invention is to provide an improved decking system that is economical in cost to manufacture.

Statements of the Invention

The improved system of the present invention provides an elongated underdeck fastening system in which a pair of metallic clips, each having a particular cross-sectional appearance is secured adjacent opposite parallel side faces of a deck joist. The deck planking is then secured to such metallic member from underneath the deck plank.

The present invention broadly provides an underdeck elongated fastening clip, which is bent from an elongated metallic sheet of a predetermined width, the clip having a profile defined by a fastening flange, a depending facia projecting at right angles to the fastening flange from the leading edge thereof, and terminating in an intersecting valley, an angularly-upwardly-extending track projecting from the intersecting valley at the lower end of the depending facia, and a washer flange extending outwardly from the leading edge of the angular track.

The present invention also provides a deck fastening system comprising: an elongated joist; and a pair of underdeck fastening clips secured thereto in edge-to-edge butting relation, and along opposite parallel side faces of the elongated joist, each clip comprising: an elongated metallic sheet of a predetermined width, the clip having a profile defined by a fastening flange, a depending facia projecting at right angles to the fastening flange from the leading edge thereof and terminating in an intersecting valley, an angularly-upwardly-extending track projecting from the intersecting valley at the lower end of the depending facia, and a washer flange extending from the leading edge of the angular track, the fastening flange being secured to an upper face of the joist, and the track being adapted to be secured to the underface of a deck plank disposed atop the elongated joist.

Other Features of the Invention

In one feature of the fastening clip, the fastening flange is provided with a plurality of pre-pierced holes.

In another feature of the fastening clip, the valley is provided with a plurality of longitudinally-spaced-apart water drainage holes.

In a further feature of the fastening clip, the washer flange is provided with a plurality of pre-pierced holes.

By a feature of the deck fastening system, each fastening flange is provided with a plurality of spaced-apart nailing apertures, whereby the clip is attached to the upper face of the joist.

In another feature of the deck fastening system, the washer flange is provided with a plurality of nailing holes, whereby the deck plank is secured by underside nails through the securing holes.

BRIEF DESCRIPTION OF THE DRAWINGS

In the accompanying drawings.

DESCRIPTION OF THE PREFERRED EMBODIMENTS

Figure 1:
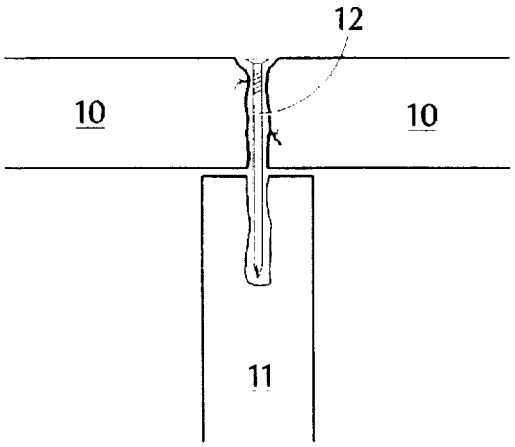
FIG. 1 is a cross-section of a typical conventional deck plank construction.

Description of FIG. 1

As seen in FIG. 1, in the prior art the deck plank 10 is secured to the deck joist 11 by means of nails or screws 12. Since deck planks will shrink over time, the nails or screws become loose and may pop up. This is hazardous and allows moisture to penetrate not only the deck plank but also the joist as well, thereby promoting rot.

Figure 2:
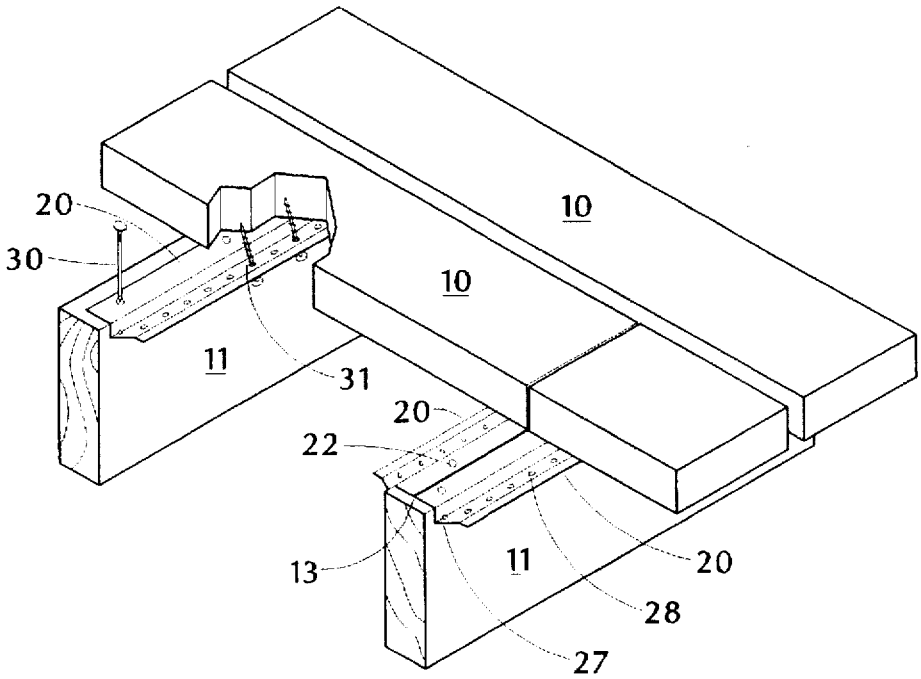
FIG. 2 is an isometric view, partially broken away of the underdeck fastening system of a broad aspect of this invention.

Description of FIG. 2

As seen in FIG. 2, the deck planks 10 are secured to the clips 20 forming one component of the system of this invention, the clip 20 being attached to the deck joists 11 in edge-to-edge butting relationship at 13.

Figure 3:
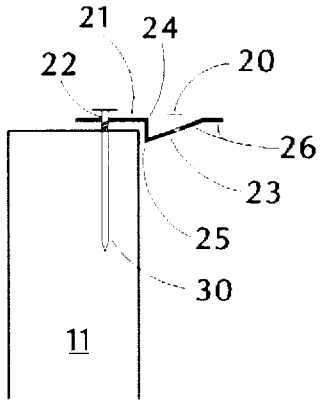
FIG. 3 is a cross-sectional view of the underdeck fastening system after one stage of its construction.
Figure 4:
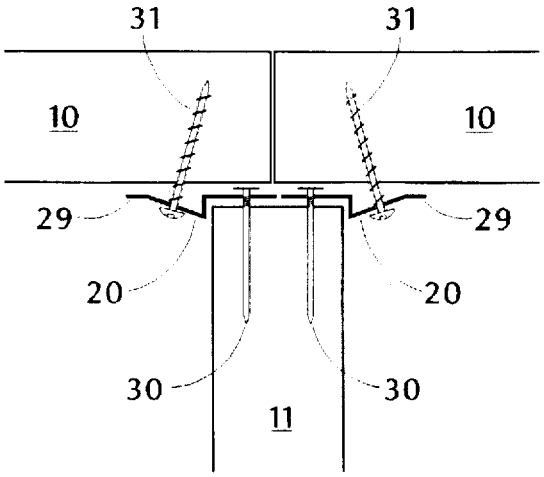
FIG. 4 is a cross-sectional view of the included fastening system in its fully assembled stage.

Description of FIGS. 3 & 4

The cross-sectional configuration of the clip 20 is shown in FIGS. 3 and 4. The clip 20 includes a fastening flange 21. This flange is set on the joist and is fastened by means of nails or screws 30 through pre-pierced holes 22. An integral depending facia 23 extends downwardly from a 90° downward folded edge 24 of fastening flange 21. The facia 23 is then bent upwardly at an oblique angle at a valley 25 to provide an upwardly-standing angular track 26. Longitudinally-spaced-apart holes 27 (see FIG. 2) along the valley 25 of the track 26 allows moisture to drain freely. The track 26 is also provided with a plurality of longitudinally-spaced-apart fastening holes 28 by means of which the deck plank 10 is secured by screws or nails 31. The track 26 terminates in a washer flange 29 extending from its outside lateral edge, the washer flange being rested upon by the lower face of the deck plank 10. Washer flange 29 acts like a washer providing pressure against the deck and not allowing the track to be drawn into the deck plank as the fastener is installed.

A reversed clip is applied to the other side face of the joist, (as seen in FIG. 4) to allow for butt joists.

OPERATION OF PRIFERRED EMBODIMENTS

In use, the underdeck fastening system clip is nailed or secured to the joist. The deck planks are then laid, one by one atop the clip. Screws secure each deck plank from below.

The angle of the track allows the fastening device to be held at a comfortable angle, whether the installer is fastening from above or below the deck planks. The track angle also provides pressure on the fastener acting like a lock washer. Pre-pierced holes in the track angle are spaced to accommodate any size deck plank-minimum of 3 fastener holes for planks 6" or wider. The vertical leg of the track provides ease of installation as the bend is set along the joist.

CONCLUSION

Some benefits of eliminating the fasteners from the top of the deck planks are as follows:

1) Moisture is not allowed to enter the deck planks from around the fasteners;
2) Rot is deterred since unnatural moisture entry is eliminated;
3) Eliminates splinters and checks caused by the fasteners; and
4) Deck finish will not be marred by the fasteners or the fastening devices.

The fasteners used to secure the clip to the joist and the deck plank to the clip, should be made of galvanized, stainless steel or zinc plate.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A clip for fastening an underface of a deck plank to an upperface of a joist, the clip comprising an elongated metallic sheet of a predetermined width, said clip having a profile defined by: a fastening flange having a leading edge; a depending facia having an upper end attached to the fastening flange and a lower end, said facia projecting at a right angle to said fastening flange from the leading edge thereof and terminating in an intersecting valley at said lower end; an angularly-upwardly-extending track having a leading edge, said angularly-upwardly-extending track projecting from said intersecting valley at the lower end of said depending facia; and a washer flange extending outwardly from the leading edge of said angularly-upwardly-extending track, the clip further comprising, connecting means for connecting the fastening flange to the upper face of the joist; and attachment means for attaching the angularly-upwardly-extending track to the underface of the deck plank.

2. The clip of claim 1, wherein said fastening flange is provided with a plurality of pre-pierced holes.

3. The clip of claim 1, wherein said valley is provided with a plurality of longitudinally-spaced-apart water drainage holes.

4. The clip of claim 1, wherein said washer flange is provided with a plurality of pre-pierced holes.

5. A deck fastening system for securing a lower face of a deck plank to an upper face of a joist comprising: an elongated joist; and a pair of elongated underdeck fastening clips secured thereto in edge-to-edge abutting relation and along opposite parallel side faces of said elongated joist, each of said elongated underdeck fastening clips comprising an elongated metallic sheet of a predetermined width, each of the clips having a profile defined by a fastening flange having a leading edge, a depending facia having an upper end attached to the fastening flange and a lower end, the facia projecting at a right angle to said fastening flange from the leading edge thereof, and terminating in an intersecting valley at said lower end; an angularly-upwardly-extending track having a leading edge, the angularly-upwardly-extending track projecting from said intersecting valley at the lower end of said depending facia; and a washer flange extending from the leading edge of said angularly-upwardly-extending track; said fastening flanges being secured to an upper face of said joist, and said tracks being adapted to be secured to the underface of the deck plank.

6. The deck fastening system of claim 5, wherein said fastening flanges are provided with a plurality of spaced apart pre-pierced fastening holes.

7. The deck fastening system of claim 5, wherein said valleys are provided with a plurality of spaced-apart water drainage holes.

8. The deck fastening system of claim 5, wherein said washer flanges are provided with a plurality of pre-pierced securing holes.

* * * * *